US007267377B2

(12) United States Patent
Marzolf et al.

(10) Patent No.: US 7,267,377 B2
(45) Date of Patent: Sep. 11, 2007

(54) LATCH ASSEMBLY FOR A MOVABLE CLOSURE ELEMENT

(75) Inventors: Ricci L. Marzolf, New Hampton, IA (US); Joe Daniel Knight, Nashua, IA (US); Bruce E. Kallevig, Monticello, MN (US); Bruce E. Frohman, Robbinsdale, MN (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 10/386,350

(22) Filed: Mar. 11, 2003

(65) Prior Publication Data

US 2004/0113435 A1 Jun. 17, 2004

Related U.S. Application Data

(63) Continuation-in-part of application No. 10/316,357, filed on Dec. 11, 2002, now Pat. No. 6,942,259.

(51) Int. Cl.
*E05C 7/00* (2006.01)

(52) U.S. Cl. ..... 292/25; 292/26; 292/27; 292/48; 292/216; 292/29

(58) Field of Classification Search ..... 292/8, 292/11, 24–26, 27, 56, DIG. 38, 29, 48, 216
See application file for complete search history.

(56) References Cited

U.S. PATENT DOCUMENTS 621,574 A * 3/1899 Kinsey ..... 292/24
1,574,023 A * 2/1926 Crompton et al. ..... 292/24
2,506,943 A * 5/1950 Shreve ..... 292/30
3,179,997 A * 4/1965 Jalinaud ..... 24/645
3,630,557 A * 12/1971 Pierce et al. ..... 292/45
3,666,305 A * 5/1972 Schlichter ..... 292/48
3,784,241 A * 1/1974 Pickles ..... 292/216
3,905,624 A * 9/1975 Fujita ..... 292/11
4,290,633 A * 9/1981 Sullivan ..... 292/114
4,783,103 A * 11/1988 Schlegel ..... 292/216
4,836,707 A * 6/1989 Myers ..... 403/322.4
5,171,048 A * 12/1992 Weinerman et al. ..... 292/45
5,209,530 A * 5/1993 Kolloch ..... 292/27
5,520,423 A * 5/1996 Finkelstein et al. ..... 292/146

(Continued)

OTHER PUBLICATIONS

English translation of the French patent 75825.*

*Primary Examiner*—Jack W. Lavinder
(74) *Attorney, Agent, or Firm*—Wood, Phillips, Katz, Clark & Mortimer

(57) ABSTRACT

A latch assembly for a movable closure element. The latch assembly has a housing, a first rotor movable relative to the housing selectively between a) a first latched position and b) a release position, and a second rotor movable relative to the housing selectively between a) a first latched position and b) a release position. The first rotor has a first throat to receive a strike element. The latch assembly further has an operating assembly with a latched state and an unlatched state. The operating assembly in the latched state releasably maintains the first rotor in its first latched position and the second rotor in its first latched position. The first rotor is movable substantially parallel to a reference plane as the first rotor moves between its first latched and release positions. The first rotor has a non-uniform thickness taken orthogonally to the reference plane.

39 Claims, 9 Drawing Sheets

U.S. PATENT DOCUMENTS 5,725,260 A * 3/1998 Eikmeier et al. ..... 292/129
6,158,787 A * 12/2000 Kutschat ..... 292/214
6,463,773 B1 * 10/2002 Dimig ..... 70/277
6,471,260 B1 * 10/2002 Weinerman et al. ..... 292/216
6,654,990 B2 * 12/2003 Liu ..... 24/598.5
6,729,661 B2 * 5/2004 Perez-Sanchez ..... 292/25

* cited by examiner

LATCH ASSEMBLY FOR A MOVABLE CLOSURE ELEMENT

CROSS-REFERENCE

This application is a continuation-in-part of application Ser. No. 10/316,357 filed Dec. 11, 2002 now U.S. Pat. No. 6,942,259, entitled "Latch Assembly".

BACKGROUND OF THE INVENTION

1. Field of the Invention

This invention relates to latch assemblies and, more particularly, to a latch assembly that can be used to releasably maintain a movable closure element in a desired position relative to a support therefor.

2. Background Art

Movable closure elements are used in many industries in both static environments and on moving equipment. These closure elements are commonly pivoted, or translated, between different positions, normally opened and closed positions, to selectively block and allow access to, a space fronted by the closure element.

An exemplary latch assembly, utilized on the above type of closure element, is shown in U.S. Pat. No. 6,158,787, to Kutschat. Kutschat employs two throated rotors 16 which are repositionable to cooperatively engage with a strike element 4. The rotors 16 are designed to be selectively maintained in secondary latched positions, as shown in FIG. 7B, and primary latched positions, as shown in FIG. 7C. The primary and secondary latched positions are maintained by the end of an L-shaped arm 28, which is movable about a pivot 56 between positions wherein the arm 28 is engaged with the rotors 16, to maintain their latched positions, and disengaged from the rotors. The free end of the arm 28 is spaced from the pivot 56 and travels in an arcuate path between its rotor-engaged and rotor-disengaged positions. Accordingly, as the arm 28 is pivoted to effect disengagement, the rotor 16 most remote from the pivot 56 must be pivoted to clear the arcuately moving free end of the arm. As a result, significant resistance to pivoting of the arm 28 may be imparted by the rotor 16.

It is conventional to stamp the rotors from relatively thick metal stock or to form the rotors from metal. Typically, the metal rotors are pivotably mounted on pins/axles within a receptacle defined by facing surfaces of a housing. The thickness of the rotors is normally substantially less than the spacing between the facing housing surfaces. As a result, the pins/axles and/or housing must be provided with support surfaces to maintain the desired axial position of the rotors relative to their associated mounting pin/axle.

Aside from requiring special pins/axles with supporting, axially facing surfaces, the rotors may be prone to skewing relative to their associated pin/axle. Commonly, the contact area between the rotors and pins/axles is relatively small so that a certain degree of skewing is inevitable. Alternative arrangements are known in the art to confine movement and skewing of the rotors. For example, as shown in U.S. Pat. No. 6,158,787, to Kutschat, one of the housing parts has an offset end which is bent to confine the axial rotor shifting. The potential for rotor skewing exists likewise with this design.

By reason of the relatively small contact area between the axially extending surfaces on the rotors and the cooperating pins/axles, these surfaces are prone to considerable wear. Similarly, a catch element, which contacts the rotors to maintain the same in at least a primary latched position, engages the rotors along a relatively short axial distance. To avoid excessive wear, these catches have likewise commonly been made from a metal material.

By having to use metal for the rotors and catch elements, the costs attendant the manufacture of these elements may be relatively high. At the same time, metal parts are prone to corrosion in certain severe environments in which they are used. This may lead to deterioration of the latch assembly components and ultimately to the premature failure of the latch assembly.

Still further, the metal parts generally have a relatively high coefficient of friction between the surfaces which coact. This may lead to binding between the metal parts that are required to act, one against the other.

One problem with existing latch assemblies is attributable to the fact that the closure element must be nearly closed for the rotors to achieve the secondary latched positions. The present design of glass doors on agricultural tractors requires significant camber built in to the door to compensate for the inherent flexing of the door. In addition, all-glass doors require more momentum to be closed to the secondary latched position and some never achieve full closing to the primary latching position. It has been observed that doors can be accidentally left ajar. With the equipment being transported at high speeds, the door can fly open and possibly shatter.

Another problem with the prior art latch assemblies has been that with the conventional latch assembly construction, the secondary latched positions for the rotors may be almost indistinguishable from the primary latched positions by viewing the position of the closure element. As a result, a user may mistakenly believe that the unlatched closure element, which is but slightly ajar, is positioned so that the rotors are in their secondary latched positions. This could lead to a situation in which the unlatched closure element may be inadvertently opened or otherwise undesirably allowed to reposition. There is also a potential problem I the manufacturing and assembly operation that can lead to additional time spent to install the latch and door plus rework and warranty costs to correct this condition in the field.

SUMMARY OF THE INVENTION

In one form, the invention is directed to a latch assembly for a movable closure element. The latch assembly has a housing, a first rotor movable relative to the housing selectively between a) a first latched position and b) a release position, and a second rotor movable relative to the housing selectively between a) a first latched position and b) a release position. The first rotor has a first throat to receive a strike element. The latch assembly further has an operating assembly with a latched state and an unlatched state. The operating assembly in the latched state releasably maintains the first rotor in its first latched position and the second rotor in its first latched position. The first rotor is movable substantially parallel to a reference plane as the first rotor moves between its first latched and release positions. The first rotor has a non-uniform thickness taken orthogonally to the reference plane.

In one form, the first rotor has a body with a mounting portion that has a first thickness and is connected to the housing for guided movement relative to the housing as the first rotor changes between its first latched position and its release position. The body further has an extension from the mounting portion defining the first throat. The extension has a portion that has a second thickness that is less than the first thickness.

In one form, the first and second rotors are constructed so that they are interchangeable.

The first rotor may be made from a non-metal material.

In one form, the housing has facing surfaces which bound a chamber, with the facing surfaces spaced from each other a first distance. The first rotor has a portion with a first thickness that is slightly less than the first distance.

In one form, the first rotor has a first portion, and the second rotor has a second portion which overlaps the first portion between the facing surfaces.

In one form, where the first and second portions overlap, the first and second portions have a combined thickness that is slightly less than the first distance.

In one form, where the first and second portions overlap, the combined thickness is approximately equal to the first thickness.

The second rotor may have a second throat to receive a strike element.

The first and second rotors may be pivotable relative to the housing between their first latched and release positions.

In one form, an axle extends through the mounting portion of the first rotor to mount the first rotor for pivotable movement relative to the housing.

In one form, with the first and second rotors in their respective first latched positions, the first and second rotors cooperatively bound a receptacle to confine a strike element received in the first and second throats.

The operating assembly may include a catch which engages the mounting portion of the first rotor to maintain the first rotor in its first latched position.

The catch may have a thickness on the order of the first thickness at a location where the catch engages the mounting portion of the first rotor.

In one form, the first rotor has a stop surface that engages a surface on the catch to maintain the rotor in its latched position. In one form, the stop surface and the surface of the catch are both made from a non-metal material.

In one form, the stop surface and the surface of the catch each have a thickness on the order of the first thickness.

The first rotor may be biased toward its release position.

The invention contemplates the combination of the latch assembly with a movable closure element.

The invention further contemplates the combination of the above structure with a support for the closure element, with the closure element movable relative to the support between first and second positions, with a strike element received by the first throat with the closure element in its first position.

The invention also contemplates the combination of a closure element, a support on which the closure element is mounted for selective movement relative to the support between first and second positions, a strike element on the support, and a latch assembly as described above.

The invention is further directed to a latch assembly for a movable closure element having a housing with a first rotor movable relative to the housing selectively between a first latched position and a release position, and a second rotor movable relative to the housing selectively between a first latched position and a release position. The first rotor has a first throat to receive a strike element. The latch assembly further has an operating assembly having a latched state and an unlatched state. The operating assembly in the latched state releasably maintains the first rotor in its first latched position and the second rotor in its first latched position. The first rotor is movable substantially parallel to a reference plane as the first rotor moves between the first latched and release positions. The first rotor having a thickness taken orthogonally to the reference plane that is non-uniform.

The first distance may be on the order of 0.75 inches.

In one form, with the first and second rotors in their second latched positions, the first and second rotors extend fully around the receptacle.

DETAILED DESCRIPTION OF THE DRAWINGS

Figure 1:
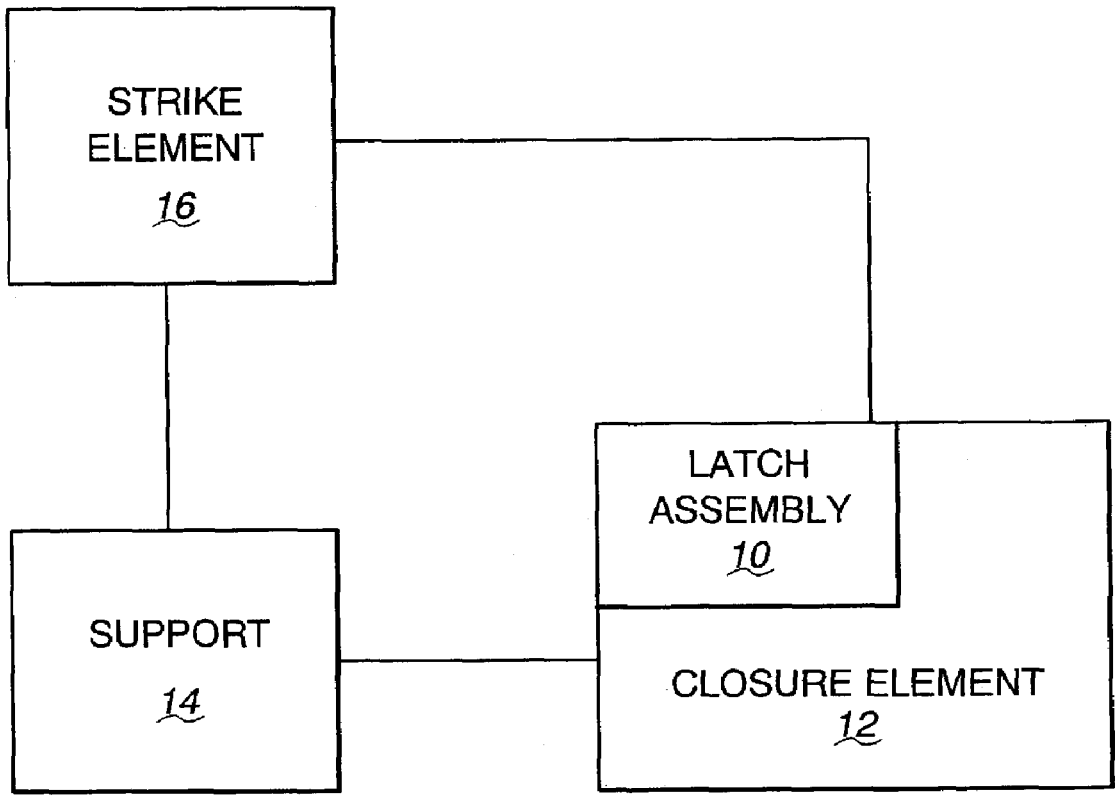
FIG. 1 is a schematic representation of a latch assembly for a movable closure element mounted to a support, according to the present invention.

The present invention is directed to a latch assembly, as shown generically at 10 in FIG. 1. The latch assembly 10 is associated with a closure element 12 which is mounted for movement relative to a support 14 between first and second positions. The first and second positions may be closed and opened positions between which the closure element 12 is moved to selectively block, and permit access to, a space associated with the support. However, it is not necessary that the closure element 12 be movable between the first and second positions strictly for that purpose. The support 14 can be virtually any structure. As just an example, the support 14 might be part of a static environment, such as on a building, or a cabinet. Alternatively, the support 14 could be on a moving vehicle, such as a tractor. In the latter case, the closure element 12 might be a door or window structure that is either pivotably mounted, or mounted for translational movement between first and second positions. The support 14 has an associated strike element 16, which cooperates with the latch assembly 10 to releasably maintain the closure element 12 in one of the first and second positions therefor.

Referring now to FIGS. 2-8, the latch assembly 10, according to the present invention, consists of a housing 18 with joinable first and second housing parts 20, 22. The rectangular shape of the housing 18 is but exemplary. The housing parts 20, 22 are joined through a plurality of, and in this case four, hollow cylindrical axles 24, 26, 28, 30. Three of the axles 24, 26, 28 have the same construction. Exemplary axle 24 has a cylindrical main portion 32 and reduced diameter, axially spaced ends 34, 36 which are pressed through complementary openings 38, 40 on the housing parts 20, 22, respectively. The ends 34, 36 project through their respective openings 38, 40 and are deformed externally of the housing parts 20, 22 against an annular chamfer 42 (shown only for the housing part 20) around each opening 38, 40. The axles 26, 28, 30 are assembled with the housing parts 20, 22 in the same fashion. The axles 24, 25, 28, 30 cooperatively maintain the housing parts 20, 22 in assembled relationship and in a predetermined spaced relationship so that a chamber 44 is defined between the housing parts 20, 22 to accommodate operational components, as hereinafter described. In the embodiment shown, the housing parts 20, 22 each have a generally cup-shaped configuration so that, once mated, a substantial portion of the chamber 44 is enclosed by the housing parts 20, 22.

In the embodiment shown, the housing parts 20, 22 are formed from metal sheet material. However, the housing parts 20, 22 could be made from virtually any material and could be molded in the shape shown, as opposed to being formed.

Figure 3:
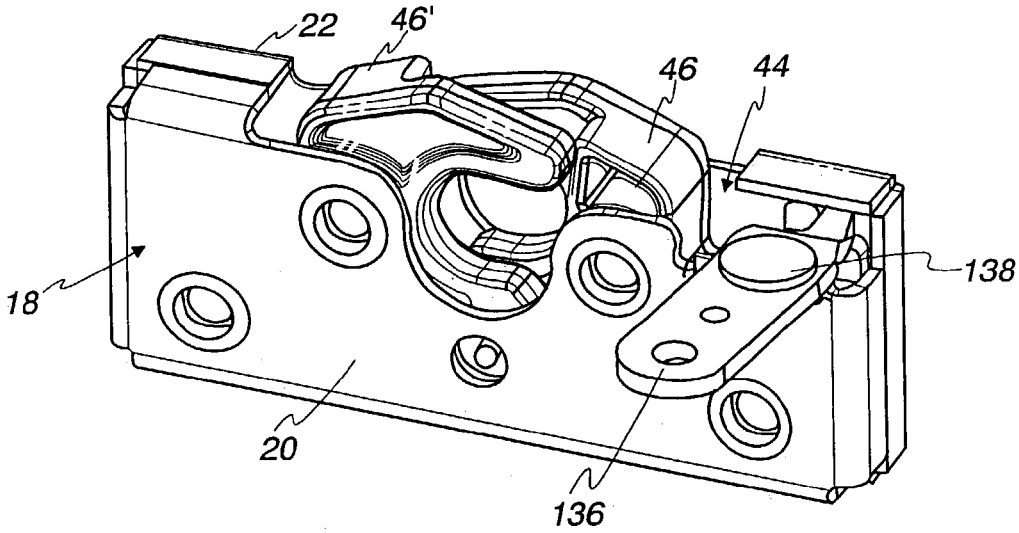
FIG. 3 is an enlarged, perspective view of the latch assembly in FIG. 2 in an assembled state and with rotors on the latch assembly in a primary latched position.

In addition to their function of interconnecting and spacing the housing parts 20, 22, the axles 24, 26, 28, 30 serve as a support for certain internal components of the latch assembly. More specifically, the axles 26, 28 support rotors 46,46' for pivoting movement between a release position, shown in dotted lines in FIG. 4, and a primary latched position, as shown in FIGS. 3 and 5. The rotors 46, 46' shown have an identical construction, however, the rotors 46, 46' have different configurations. Exemplary rotor 46 has a U-shaped body 50 with a thickened base portion 52 having a thickness T that is slightly less than the spacing in the chamber 44 between the housing parts 20, 22. Legs 54, 56, having a thickness t equal to approximately one-half the thickness T of the base part 52, project at spaced locations from the base part 52 so as to define a U-shaped throat 58 therebetween. The base part 52 and legs 54, 56 are flush on one side 60 of the rotor 46 so that the base part 52 and legs 54, 56 reside in a single plane at that side 60. The rotor 46 has a through bore 62 to receive the axle 26 so that the rotor 46 is guided in pivoting by the axle 26 around an axis 64 defined by the axle 26.

The rotor 46' is reversed and inverted from the rotor 46 and mounted on the axle 28 for pivoting movement relative to the housing 18 about an axis 66, that is parallel to the axis 64. With this arrangement, the legs 54, 56 on the rotor 46, and corresponding legs 54', 56' on the rotor 46', move relative to each other in a scissors-type action, parallel to a reference plane 67, as the rotors 46, 46' are changed between their release positions and primary latched positions. the thicknesses T, t are defined between spaced, parallel reference planes, that are in turn parallel to the reference plane 67.

Figure 4:
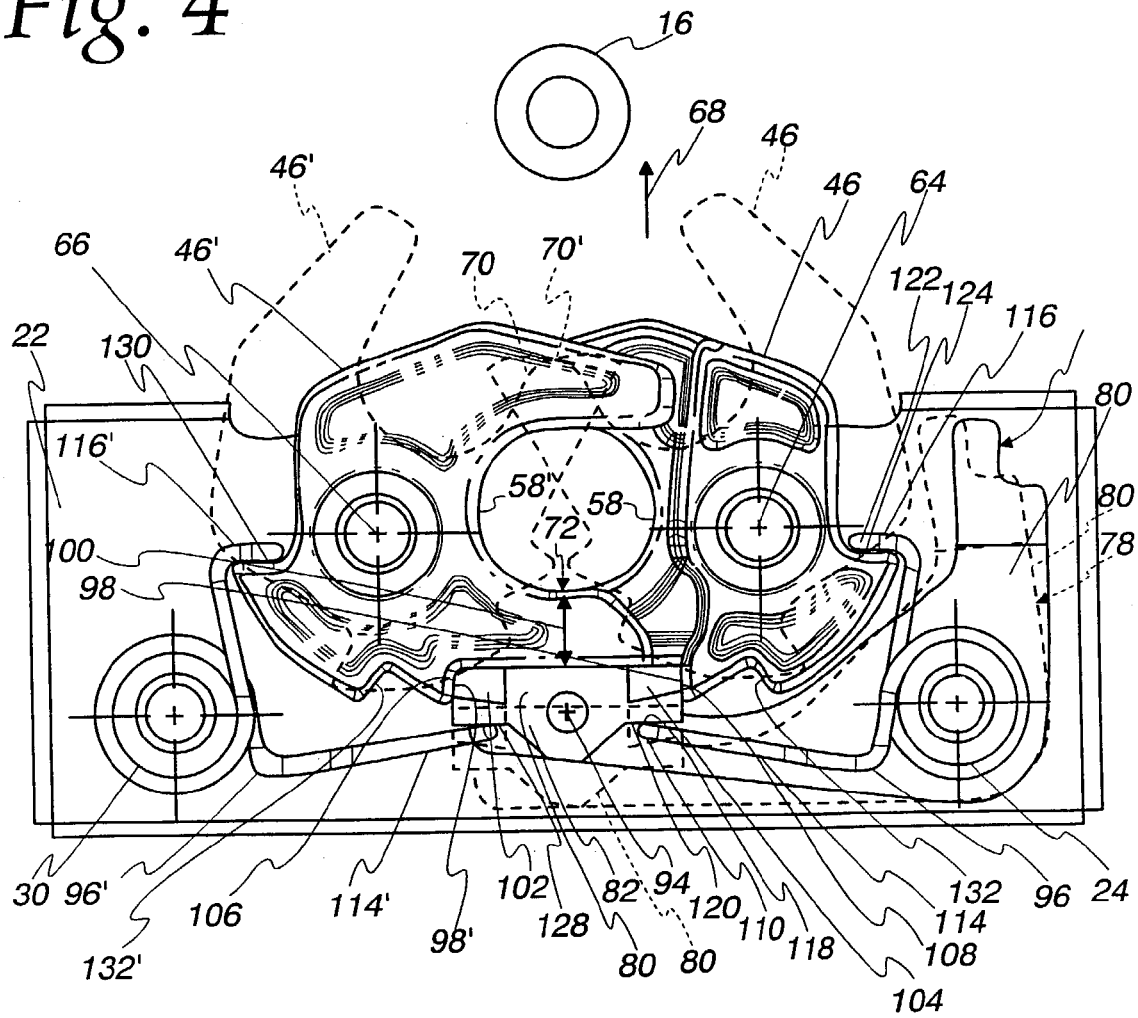
FIG. 4 is an enlarged, side elevation view as in FIG. 3 with a housing portion removed and showing the rotors in release positions in phantom lines and in primary latched positions in solid lines.
Figure 5:
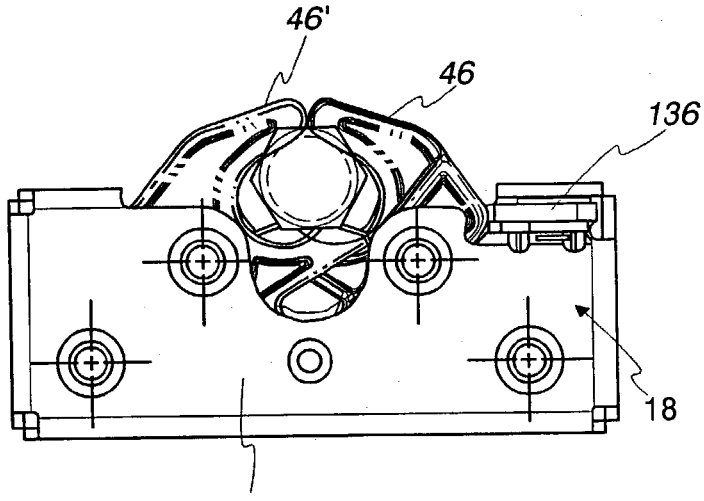
FIG. 5 is a side elevation view, corresponding to that in FIG. 4, with the rotors in a secondary latched position.
Figure 6:
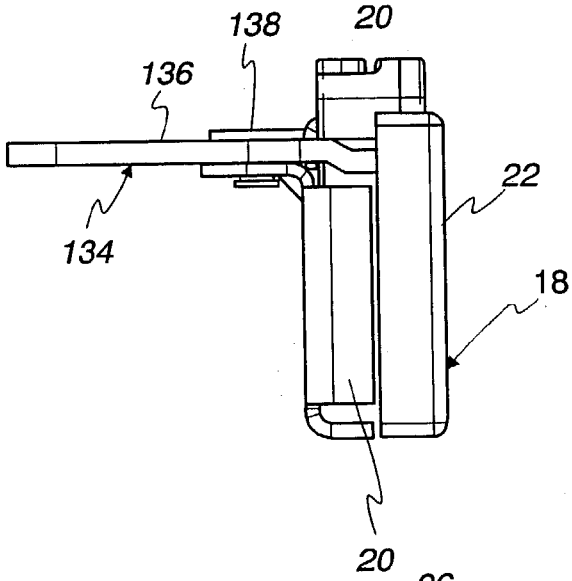
FIG. 6 is an end elevation view of the assembled latch assembly in FIGS. 2-5.

With the rotors 46, 46' in their release positions, as shown in dotted lines in FIG. 4, the closure element 12 can be moved from a first position therefor into a second position. As the closure element 12 approaches the second position, the latch assembly 10 moves in the direction of the arrow 68 towards the strike element 16. The strike element 16 initially contacts inclined cam surfaces 70, 70' on the rotor legs 56, 56', respectively. Continued movement of the closure element 12 towards its second position causes the strike element 16 to progressively urge the rotor 46 about the axis 64 from its release position, shown in phantom lines in FIG. 4, in a counterclockwise direction into the primary latched position, shown in solid lines. The rotor 46' is simultaneously moved about its axis 66 in a clockwise direction from the release position into the primary latched position, shown in phantom and solid lines, respectively in FIG. 4. As the rotors 46, 46' progressively move from their release positions into their primary latched positions, the throat 58 on the rotor 46 progressively overlap and cooperatively receive the strike element 16. The scissors action of the legs 54, 56, 54', 56' causes the legs 54, 56, 54', 56' to progressively close about the strike element 16. With the rotors 46, 46' in the primary latched positions, the legs 54, 56, 54', 56' cooperatively bound a fully closed receptacle 72 within which the strike element 16 is captive.

The rotors 46, 46' are maintained in their primary latched positions by an operating assembly at 78. The operating assembly 78 consists of a catch arm 80 on which a catch block 82 is mounted. The catch arm 80 has an L-shaped configuration with a long leg 84 and a short leg 86. The catch arm 80 is pivotably connected to the housing 18 at the juncture of the long and short legs 84, 86, for pivoting movement around an axis 88, that is generally parallel to the axes 64, 66.

The catch block 82 is connected to the free end 90 of the longer leg 84 of the catch arm 80 through a pin 92. Through the pin 92, the catch block 82 is pivotable relative to the catch arm leg 84 about an axis 94, which is generally parallel to the axes 64, 66, 88.

The operating assembly 78 is changeable between a latched state, shown in solid lines in FIG. 4, and an unlatched state, shown in dotted lines in FIG. 4. In the latched state, the operating assembly 78 releasably maintains both rotors 46, 46' in their primary latched positions. The catch arm 80 is movable relative to the housing 18 from a first position, shown in solid lines in FIG. 4, into a second position, shown in phantom lines in FIG. 4, to thereby change the operating assembly 78 from the latched state into the unlatched state. Movement of the catch arm 80 from its first position into its second position causes the catch block 82 to move from an engaged position, shown in solid lines in FIG. 4, into a disengaged position, shown in phantom lines in FIG. 4.

The catch block 82 is mounted "floatingly" to the catch arm 80, and can be angularly reoriented relative to the catch arm 80 and housing 18 around the axis 94. Under the influence of two wire spring elements 96, 96', described in detail hereafter, the catch block 82 is biasably maintained in a predetermined, operating, angular orientation relative to the housing 18 and catch arm 80. The spring elements 96, 96' biasably urge the catch block 82 consistently into this orientation.

In the engaged position, the catch block 82 resides between facing stop surfaces 98, 98' on the rotors 46, 46', to thereby prohibit the rotors 46, 46' from pivoting out of their primary latched positions, i.e. by movement of the rotor 46 in a clockwise position around the axis 64 from its solid line position in FIG. 4 and the rotor 46' in a counterclockwise direction about the axis 66 from its solid line position in FIG. 4. By shifting the catch block 82 to the disengaged position, the catch block 82 is caused to clear the path of the rotors 46, 46', so that the rotors 46, 46' can move substantially unimpededly from their primary latched positions into their release positions. Because the catch block 82 is floatingly mounted upon the catch arm 80, the catch block 82 can move while maintaining the same angular orientation in substantially a straight line path, as indicated by the double-headed arrows 100, between the engaged and disengaged positions. This allows the catch block 82 to slide from between the stop surfaces 98, 98' with minimal resistance from the rotors 46, 46'. In the absence of this floating arrangement for the catch block 82, the arcuate path traveled by the catch block would force a certain amount of clockwise pivoting of the rotor 46' to allow the catch block 82 to clear away from the rotor 46' as the catch block 82 moves from the engaged position into the disengaged position.

The catch block 82 has thickened portions 102, 104 with surfaces 106, 108, which engage the rotors 46, 46' with the catch block 82 in the engaged position. Thus, a relatively large contact area between the rotor surfaces 98, 98' and catch block surfaces 106, 108 can be established. This large contact area assures that the catch block 82 and rotors 46, 46' firmly abut to each other and also reduces potential wear resulting from the repetitive contact between the rotor and catch block surfaces 98, 98', 106, 108. At the same time, the fact that the catch block 82 slides from between the rotor surfaces 98, 98' in the same operating angular orientation accounts for relatively little resistance between the catch block 82 and rotors 46, 46', compared to what the resistance would be between these same sized surfaces if the catch block 82 were required to pivot the rotor 46', as previously described, as the catch block 82 moves out of the engaged position.

As noted above, by reason of the relatively large interactive surface areas between the catch block 82 and rotors 46, 46', wear on the cooperating parts can be controlled. This arrangement lends itself to the construction of both the rotors 46, 46' and catch block 82 from moldable material, such as plastics, composites, etc. While the rotors 46, 46' and catch block 82 may be made from metal, preferably these elements are made from a non-metal material. The non-metal material has numerous advantages. First of all, a material such as plastic can be readily molded to desired shapes. Plastic material is normally lower in cost and lighter in weight than metal. Further, the plastic material is not prone to being eroded upon being exposed to moisture and chemicals commonly encountered in environments in which this type of latch assembly 10 are used.

The rotors 46, 46' are biased by the spring elements 96, 96' towards their release positions. The spring elements 96, 96' also bias the catch block 82 towards its engaged position. Both spring elements 96, 96' have the same construction. Exemplary spring element 96 will be described in detail herein.

Figure 2:
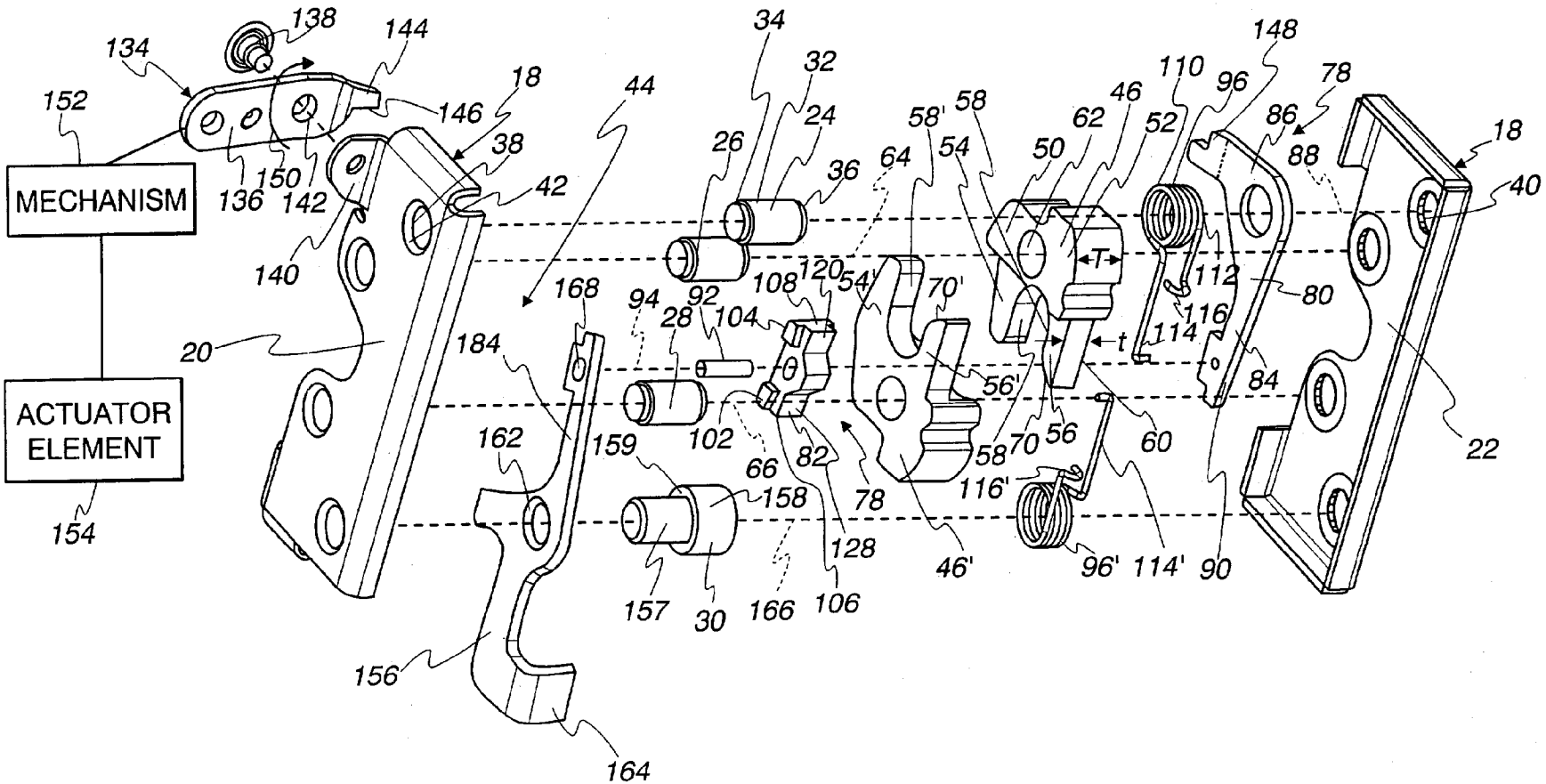
FIG. 2 is an exploded, perspective view of one form of latch assembly, according to the present invention.
Figure 7:
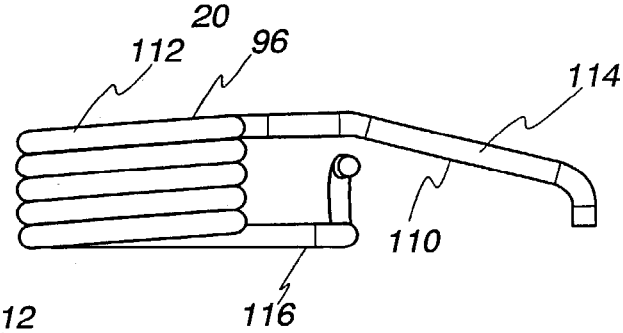
FIG. 7 is an enlarged, top view of a wire spring for biasing one of the rotors into its release position and for biasing a catch block towards a position wherein the catch block releasably maintains the rotor selectively in each of the primary and secondary latched positions.
Figure 8:
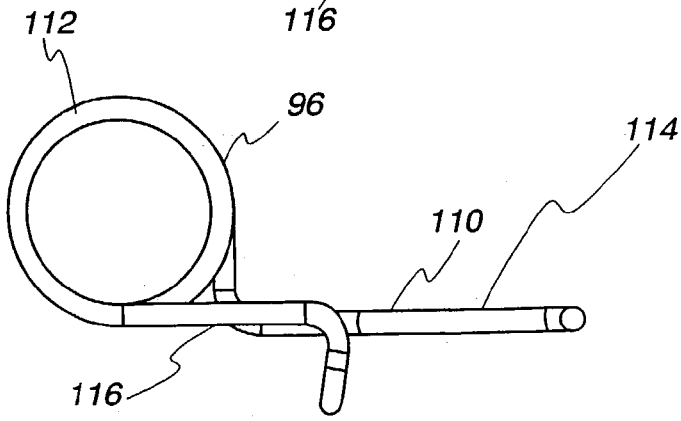
FIG. 8 is a side elevation view of the spring in FIG. 7.

As seen most clearly in FIGS. 7 and 8, taken in conjunction with FIGS. 2 and 4, the spring element 96 is defined by a formed wire 110. The formed wire 110 has a coiled center 112, which surrounds the axle 24, and free ends 114, 116 projecting therefrom. The free end 114 is loaded so that an offset end 118 bears on a shoulder 120 at a first location on the catch block 82, thereby urging the catch block 82 towards the engaged position therefor. The spring end 116 has an offset portion 122 which is loaded to bear against a shoulder 124 on the rotor 46, to thereby urge the rotor 46 in a clockwise direction about the axis 64 in FIG. 4, i.e. towards the release position for the rotor 46.

The spring element 96' surrounds the axle 30 and has corresponding free ends 114', 116', which bear respectively on a shoulder 128 on the catch block 82 and a shoulder 130 on the rotor 46', to thereby urge the catch block 82 towards the engaged position and the rotor 46' towards its release position.

The spring elements 96,96' produce a balanced, biasing force on the catch block 82 at spaced locations on opposite sides of the pivot axis 94 to thereby urge the catch block 82 biasably into its desired operating angular orientation relative to the housing 18 and catch arm 80. At the same time, the spring elements 96, 96' exert a force on the catch arm 80, through the catch block 82, urging the catch arm to its first position, as shown in solid lines in FIG. 4.

The rotors 46, 46' have stop surfaces 132, 132', which function in the same manner as the stop surfaces 98, 98', previously described, in conjunction with the catch block 82. The stop surfaces 132, 132' engage the catch block 82 with the rotors 46, 46' in a secondary latched position, shown in FIG. 5.

In operation, with the rotors 46, 46' in their release positions, repositioning of the closure element 12 causes the strike element 16 to bear upon the cam surfaces 70, 70'. Continued movement of the closure element 12 causes the strike element to pivot the rotors 46, 46' towards their primary latched positions. As this is occurring, the catch block 82 is constantly biasably urged against the rotors 46, 46'. Eventually, the catch block 82 moves between the stop surfaces 132, 132' into engaged position with the rotors 46, 46', thereby maintaining the rotors 46, 46' in the secondary latched position of FIG. 5. Continued movement of the closure wedges the catch block 82 out of engagement with the stop surfaces 132, 132' and drives the rotors 46, 46' progressively toward the primary latched positions therefor, at which point the catch block 82 moves between the stop surfaces 98, 98', to releasably maintain the rotors 46, 46' in their primary latched positions.

When it is desired to release the strike element 16, an actuator 134 is operated to change the catch arm 80 from its first position to its second position, thereby moving the catch block 82 from its engaged position into its disengaged position. As this occurs, the catch block 82 moves out of the path of the rotors 46, 46', whereupon the spring elements 96, 96' drive the rotors 46, 46' back into their release positions.

The actuator 134 is shown in this embodiment as an arm 136 which is pivotably connected through a pin 138 to a tab 140 on the housing part 20. the resulting pivot axis 142 for the arm 136 is orthogonal to the pivot axis 88 for the catch arm 80.

The arm 136 has an extension 144 with a cam edge 146 which bears on an inset cam edge 148 on the catch arm 80. Pivoting movement of the arm 136 in the direction of the arrow 150 around the axis 142 pivots the catch arm 80 between the first and second positions therefor.

The actuator 134 may be directly graspable or operated through a linkage or other mechanism 152, which may in turn have an actuator element 154 that is directly operable by the user.

A secondary actuator 156 (FIG. 2) is optionally provided to effect operation of the latch assembly 10 from a location spaced from that of the actuator 134. The actuator 156 is mounted on the axle 30. The axle 30 has an enlarged, annular flange 158 to seat the actuator 156 with an end portion 160 of the axle 30 directed through a mounting opening 162. The actuator 156 has a graspable, or otherwise engageable, actuating tab 164 through which the actuator 156 can be pivoted about the axis 166 of the axle 30.

A through bore 168 is provided in the actuator 156 at a location remote from the actuating tab 164. The bore 168 receives the pin 92 on the catch block 82. By pivoting the actuator 156 about its axis 166, the catch block 82 can be selectively moved between the engaged and disengaged positions therefor.

Figure 9:
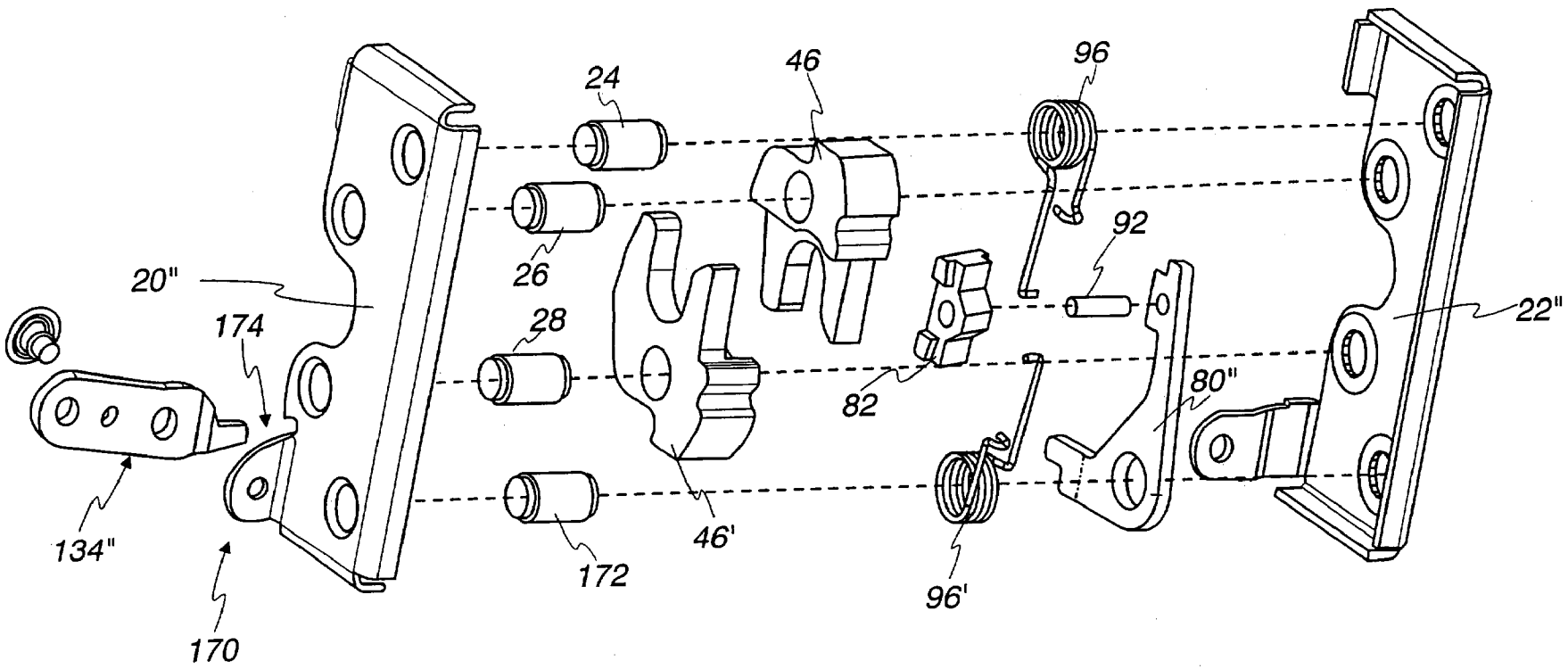
FIG. 9 is a view as in FIG. 2 of a modified, opposite-handed form of latch assembly, according to the present invention.
Figure 10:
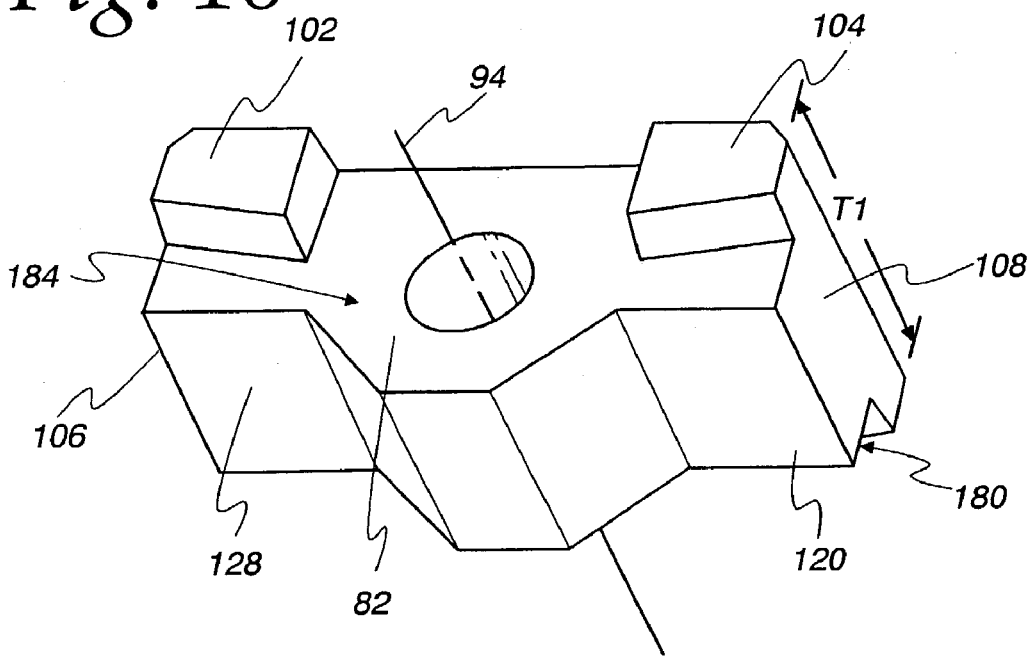
FIG. 10 is an enlarged, perspective view of a catch block on the latch assembly in FIGS. 1-9, for releasably maintaining the rotors in their latched positions.

In FIG. 9, a modified version of the latch assembly is shown at 170. The latch assembly 170 is opposite-handed from the latch assembly 10, previously described. The primary internal operating components are generally the same as those previously described and are correspondingly numbered in FIG. 9, with a few exceptions. In the latch assembly 170, the secondary actuator 156 is omitted. The flanged axle 30 is replaced with an axle 172 that is the same as the axles 24, 26, 28. The catch arm 80", corresponding to the catch arm 80, is reversed, as is the mounting location at 174 for an actuator 134", corresponding to the actuator 134 on housing parts 20", 22".

Figure 11:
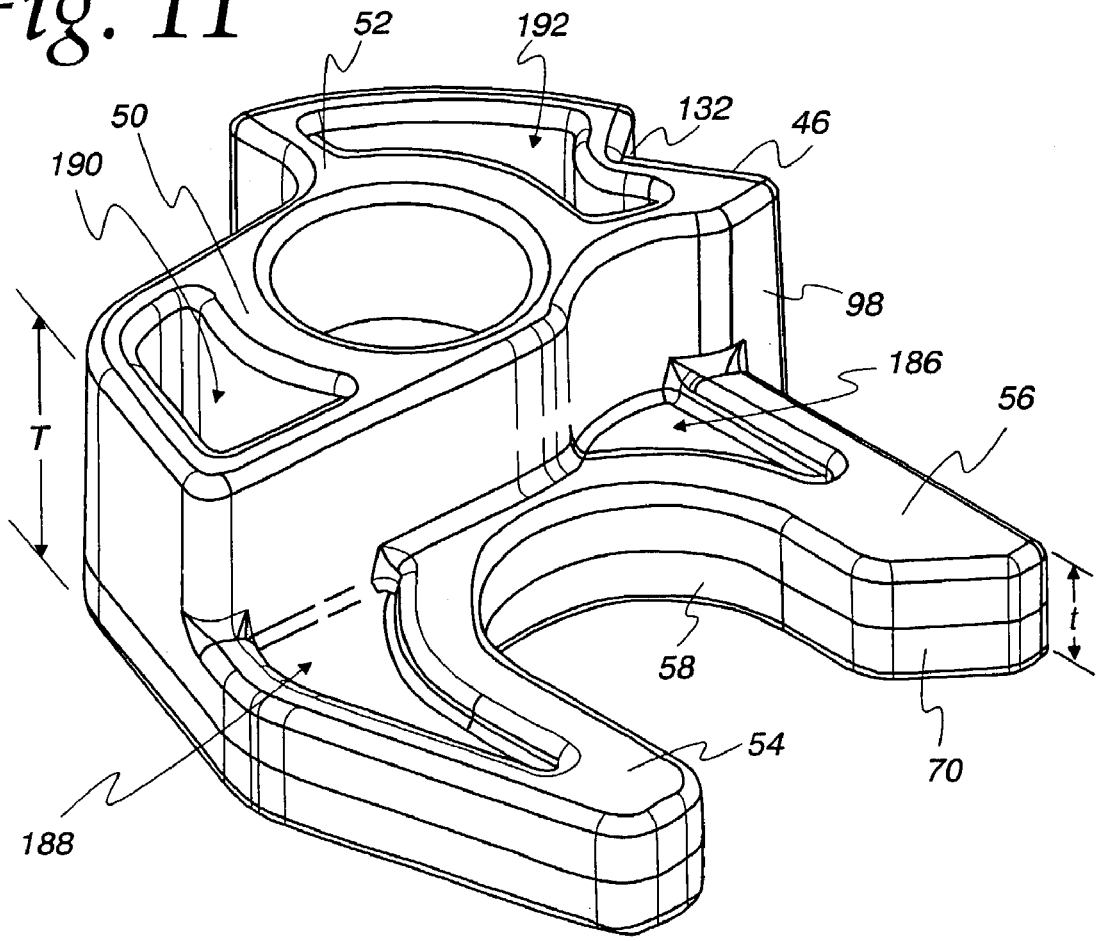
FIG. 11 is an enlarged, perspective view of one of the rotors on the latch assembly of FIGS. 1-10.
Figure 12:
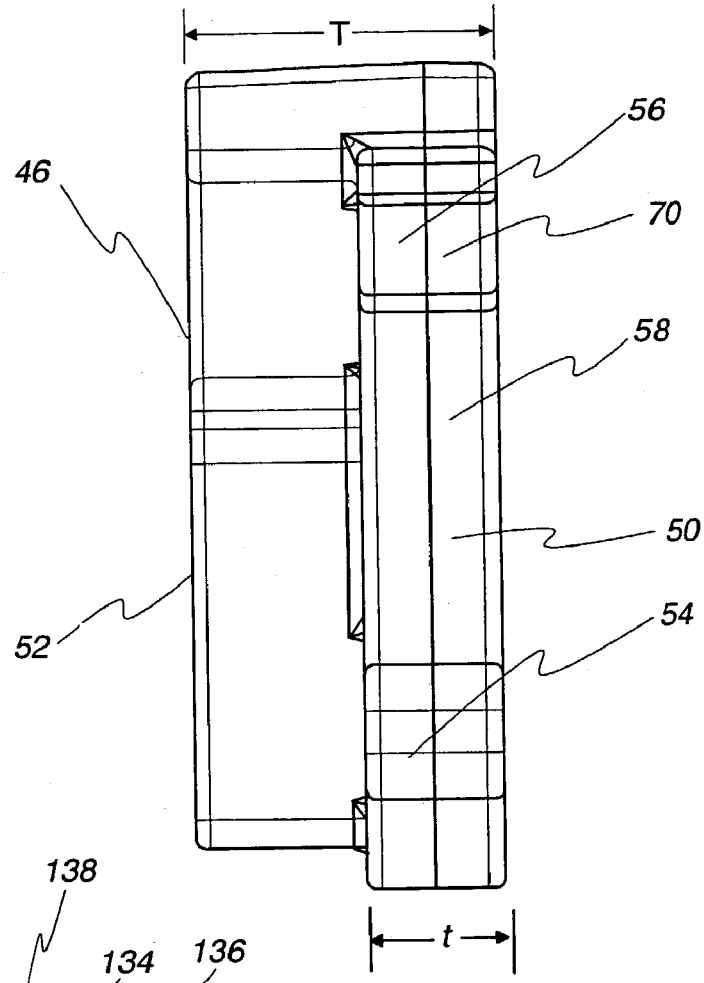
FIG. 12 is an enlarged, elevation view of the rotor in FIG. 11.
Figure 13:
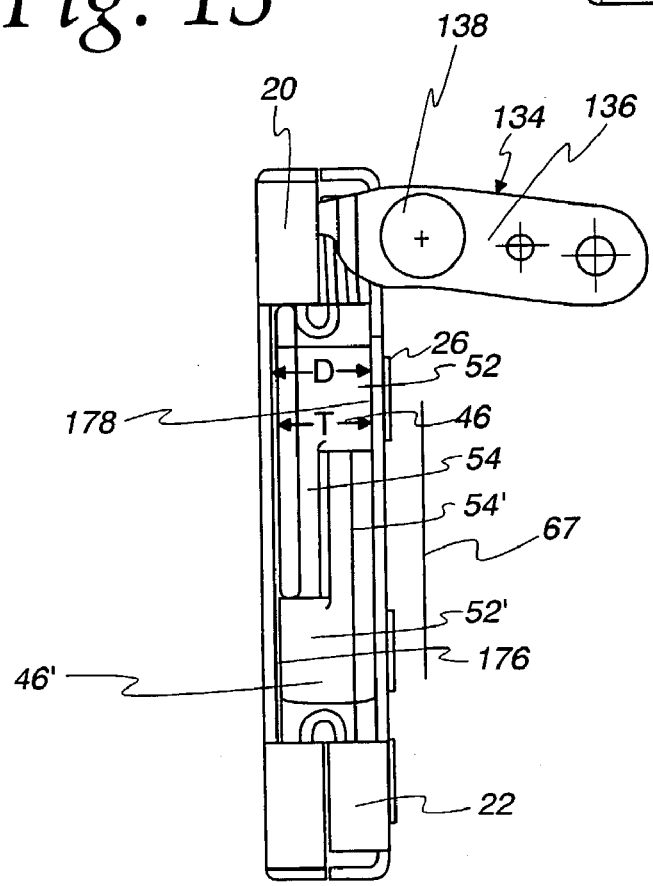
FIG. 13 is an enlarged, plan view of the latch assembly in FIGS. 1-12.

Certain additional aspects of the inventive design will now be described, specifically with respect to claims 11-13. In FIGS. 11 and 12, the details of the rotor 46 are shown. As seen in FIG. 13, the housing parts 20, 22 have facing surfaces 176, 178 which are spaced from each other a distance D. The distance D is slightly less than the thickness T of the base/mounting portion 52 of the rotor 46. The dimensions D, T are selected so that the base/mounting portion 52 is confined against any significant skewing between the facing surfaces 176, 178. At the same time, sufficient clearance is provided so that the rotor 46 does not bind as it is pivoted in operation. The thickened base/mounting portion 52 also assures that the rotor 46 is stably supported on the axle 26 that extends thereth rough. The overlapped rotor legs 54, 56, 54', 56' have a combined thickness (2×t) between the surfaces 176, 178, i.e. orthogonal to the reference plane 67, that is slightly less than the distance D. Flat surfaces on each axially oppositely facing side of the rotors 46, 46' are coplanar and reside in planes adjacent to the surfaces 176, 178. Thus, the rotor legs 54, 56, 54', 56' can be designed to securely hold the strike element 16.

Additionally, the thickened base/mounting portion 52 defines the stop surfaces 98, 132. As a result, a substantial contact area is established between the catch block 82 and each of the stop surfaces 98, 132 on the rotor 46.

Similarly, the catch block 82, as shown particularly in FIGS. 2-10, has a surface 108 with a thickness T1 that is substantially equal to the thickness T. This is made possible by defining an undercut receptacle at 180 for a mounting tab 182 (FIG. 2) on the catch arm 80, which tab 182 is mounted through the pin 92 in a manner so that the catch block 82 and catch arm 80 pivot in unison about the axis 88. Thus, a positive connection between the catch arm 80 and catch block 82 can be established while affording cooperating surfaces 108, 98, 132 on the catch block 82 and rotor 46, with a thickness just slightly less than the distance D between the facing housing surfaces 176,178 and a relatively large contact area. The receptacle 184 accommodates the actuator 156 in like fashion so that the surface thickness T1 can be maintained.

By reason of the relatively large contact area between the surfaces 108, 98, 132, the surfaces lend themselves to being made from a non-metal material, such as a plastic or composite. By reason of their relatively large contact area, these surface are not as susceptible to wear over the useful anticipated life of the latch assembly 10 as they would be with conventional cooperating surfaces of lesser area. At the same time, the cooperating non-metal surfaces 108, 98, 132 can be made from material having a relatively low coefficient of friction. This facilitates sliding of the surfaces 98, 108, 132, one against the other, during operation, thereby contributing to smooth, non-binding operation of the latch assembly. Aside from the improved operating characteristics made possible by the non-metal materials, these non-metal materials generally are less prone to deterioration in the severe operating conditions that latch assemblies of this type are often subjected to than their metal counterparts. For example, the materials may be less prone to corrosion due to encounters with chemicals and moisture.

Additionally, non-metal materials are generally less expensive than metal materials commonly used to make parts of this type. The catch block 82 and rotor 46 lend themselves to manufacture by a molding process. In the case of the rotor 46, various reliefs 186, 188, 190, 192 can be formed to reduce material requirements and weight without appreciably affecting operating characteristics.

While the rotors 46, 46' may be different in configuration, it also desirable to have the rotors 46, 46' interchangeable. In a preferred form, the rotors 46, 46' are identical in construction.

Figure 17:
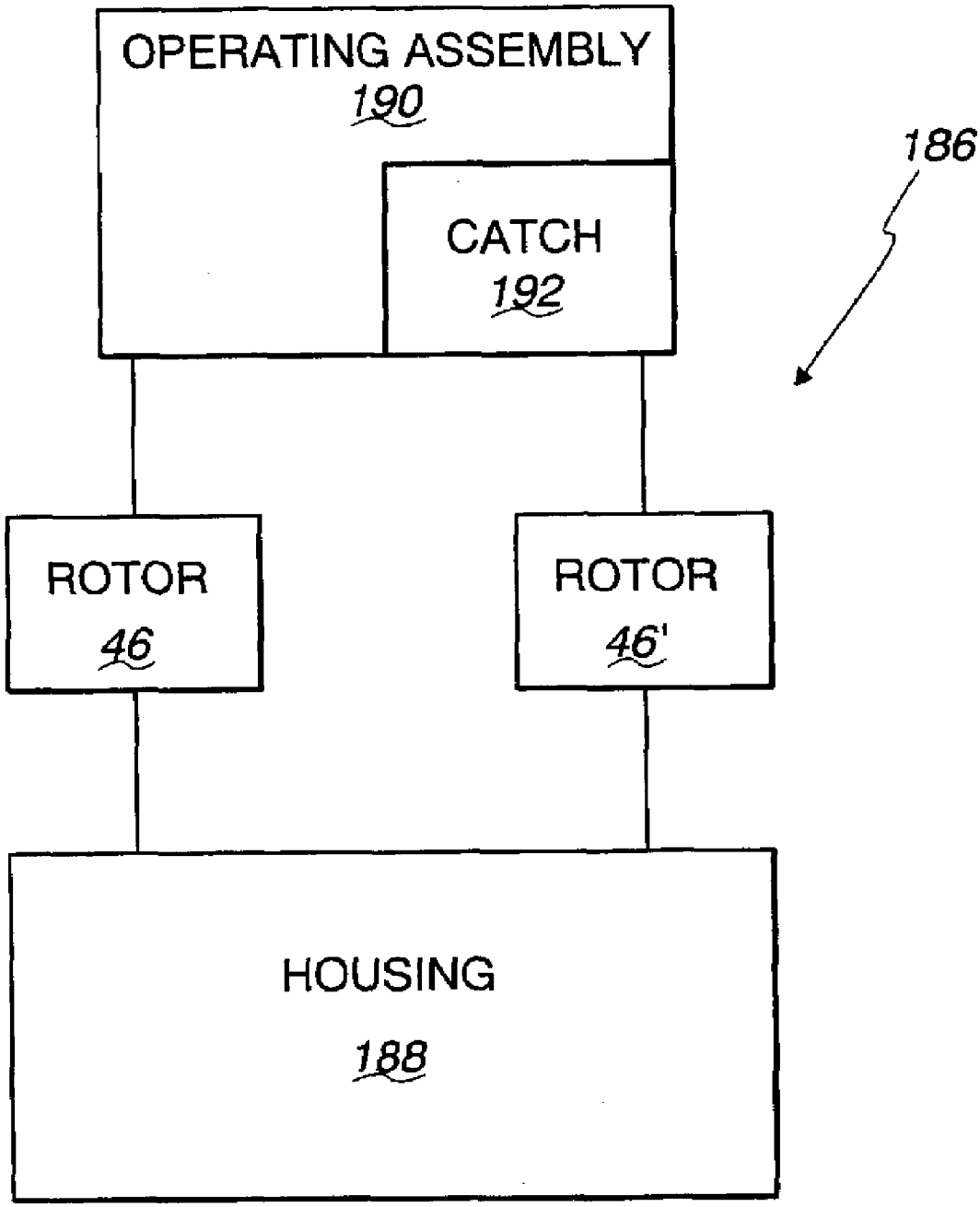
FIG. 17 is a schematic representation of a generic form of latch assembly, according to the present invention.

It should be understood that the concept of using the rotors 46, 46' having the configuration shown is not limited to the environment previously described. This rotor construction can be used in virtually any type of latch assembly as shown generically at 186 in FIG. 17. The latch assembly 186 consists of rotors 46, 46' mounted to a housing 188 for rotary, or other type of movement, between latched and release positions. An operating assembly 190, of virtually any construction, can be provided with a catch 192 to maintain the rotors 46, 46' releasably in their latched positions. For example, the operating assembly 190 is not limited to the use of a floating catch block 82 and other details previously disclosed. Similarly, non-metallic rotors 46, 46' and/or a non-metallic catch block 82 could be used in a more generic latch assembly 186, without requiring the details of the latch assembly 10, previously described.

Figure 14:
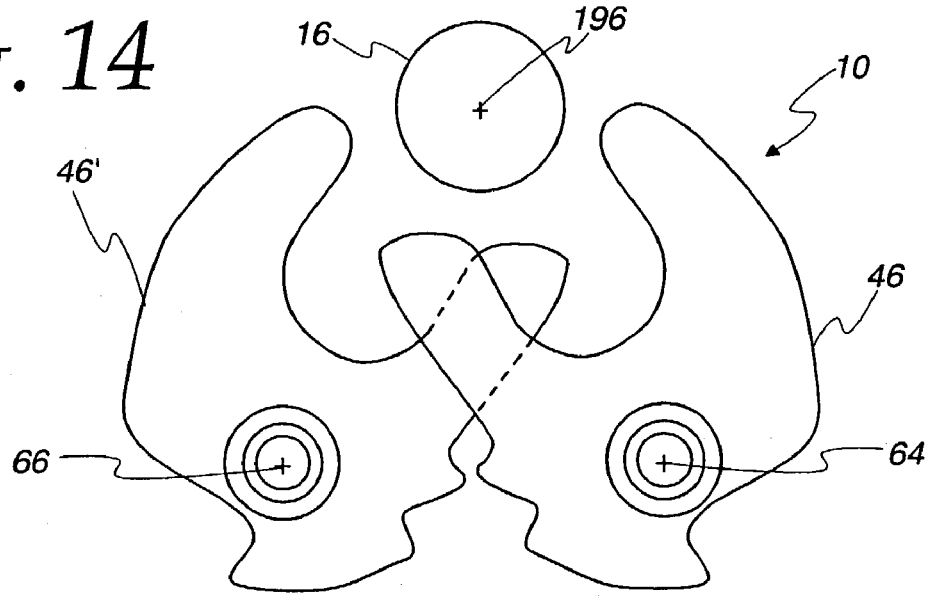
FIG. 14 is a schematic, side elevation view of the latch assembly in FIGS. 1-13 and showing the rotors in a release position with respect to a strike element.
Figure 15:
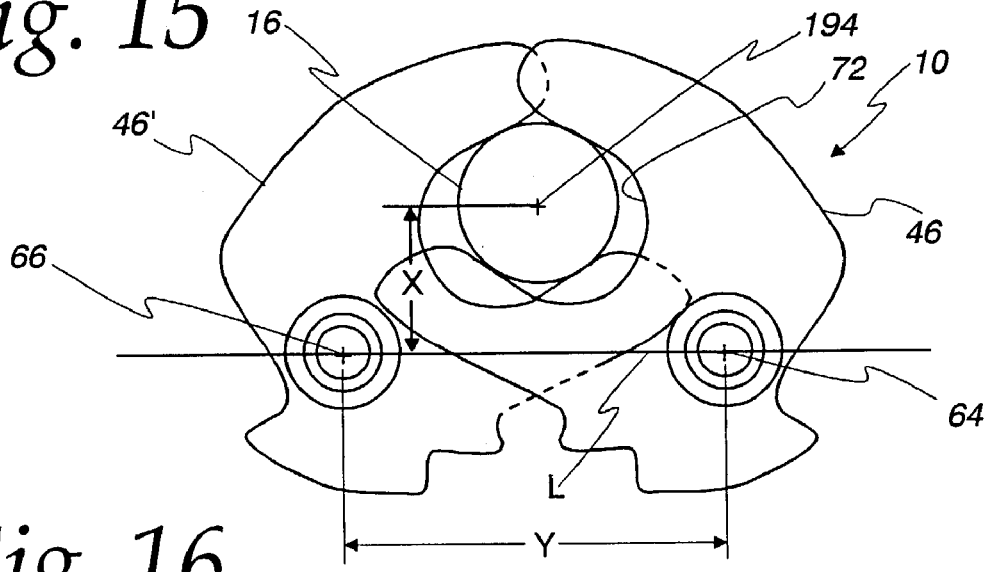
FIG. 15 is a view as in FIG. 15 with the rotors in a secondary latched position.
Figure 16:
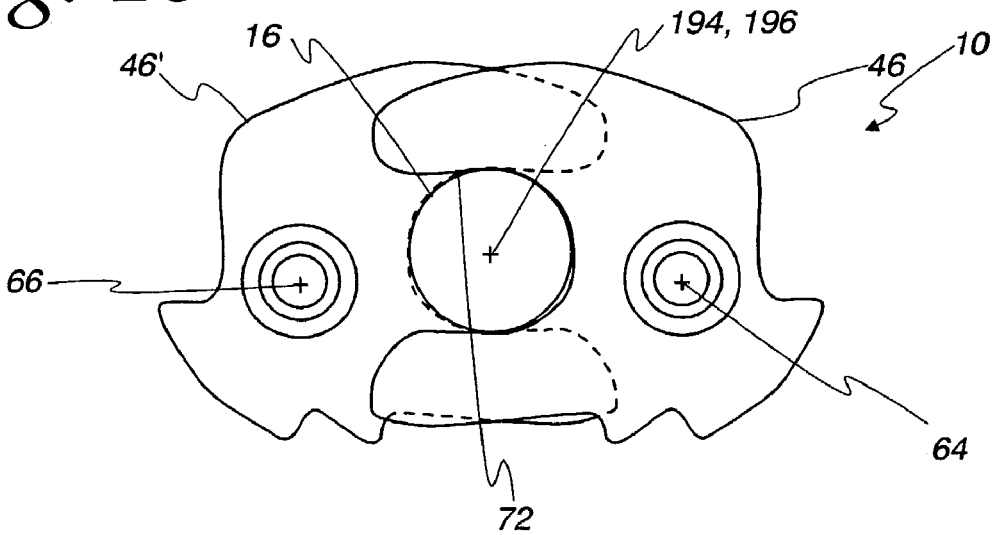
FIG. 16 is a view as in FIGS. 14 and 15 with the rotors in a primary latched position.

Another aspect of the invention is the extension of the secondary latched position for the rotors 46, 46', as shown in FIGS. 14-16. Typically, with the latch assembly in the secondary latched position, as shown in FIG. 15, the center axis 194 of the receptacle 72 generally coincides with the central axis 196 of the strike element 16. According to the invention, with the rotors 46, 46' in the secondary latched position of FIG. 14, in which the strike element 16 is precluded from escaping from the receptacle 72, the distance X, from the reference line L, extending between the axes 64, 66, to the axes 194, 196, is greater than 0.35 inches, and more preferably on the order of 0.75 inches. The axes 64, 66 may be spaced from each other on the order of 2.5 inches.

Typically, this distance X is no greater than 0.34 inches. With this conventional arrangement, a user may incorrectly assume that the closure element, which is slightly ajar, is held in the secondary latched position. This may cause the user to rely on the closure element being latched, when that is not the case. By extending the distance X to greater than 0.35 inches, and more preferably on the order of 0.75 inches, with the closure element 12 only slightly ajar, as can be visually determined by the user, the closure element 12 will be consistently latched. In other words, with the rotors 46,46' in their secondary latched positions, and the closure element pressed against the rotors 46, 46' towards an open position, the closure element will be noticeably ajar. While the closure element 12 in this state will be maintained against inadvertent opening, a user in most instances would not expect the closure element 12 to be latched and would thus not rely on this condition. Thus, within the range where a user would conventionally expect the closure element to be latched, with the inventive structure this will consistently be the case.

This arrangement may also make latching possible in environments where the closure element 12 is out of proper alignment or is flexed or bowed to a state where it might otherwise not be latched closed.

Referring to the sequence drawings in FIGS. 14-16, in the state in FIG. 14, the closure element 12 will generally be obviously unlatched as the closure element, and thus the rotors 46, 46', are moved towards the strike element 16. In FIG. 15, the closure element 12 will become latched, with the rotors 46, 46' in a secondary latched position, in an orientation that might normally not be viewed as being latched. Thus, the closure element 12 may be viewed as being "prematurely" latched, which represents a safety feature in the design of such latch assemblies 10. At the point where the closure element 12 is fully closed, the rotors 46, 46' will be in their primary latched positions, as shown in FIG. 16.

The foregoing disclosure of specific embodiments is intended to be illustrative of the broad concepts comprehended by the invention.

The invention claimed is:

1. In combination:

a) a closure element that is movable relative to a support between first and second positions; and b) a latch assembly on the movable closure element, said latch assembly comprising:

a housing attached to the movable closure element;

a first rotor movable relative to the housing selectively between a) a first latched position and b) a release position, the first rotor having first and second spaced legs and a first throat between the first and second legs to receive a strike element;

a second rotor movable relative to the housing selectively between a) a first latched position and b) a release position; and an operating assembly having a latched state and an unlatched state, the operating assembly in the latched state releasably maintaining the first rotor in its first latched position and the second rotor in its first latched position, wherein the first rotor is movable substantially parallel to a first reference plane as the first rotor moves between its first latched and release positions, the first rotor and/or the second rotor having a non-uniform thickness taken orthogonally to the reference plane, one of the first and second rotors having a first thickness residing within a space bounded by second and third, spaced, reference planes, each parallel to the first reference plane and spaced from each other by a distance equal to the first thickness, the other of the first and second rotors having a thickness substantially the same as the first thickness and residing substantially fully in the space between the second and third reference planes, the first and second rotors overlapping with each other at a first location so that the first and second rotors at the first location block a strike element in the first throat with the first and second rotors in their first latched positions, the first and second legs each overlapping the second rotor with the first and second rotors in their latched positions.

2. The combination according to claim 1 wherein the first and second rotors are respectively pivotable around first and second axes and the first and second axes are at all times fixed with respect to each other.

3. The combination according to claim 1 wherein the first and second rotors are constructed so that they are substantially the same, whereby the first and second rotors are interchangeable, one with the other.

4. The combination according to claim 1 wherein the first rotor comprises a non-metal material.

5. The combination according to claim 1 wherein the housing comprises facing surfaces which bound a chamber, the facing surfaces are spaced from each other a first distance, and the first rotor has a portion with the first thickness that is slightly less than the first distance.

6. The combination according to claim 1 wherein the housing comprises facing surfaces which bound a chamber, the first rotor has a first portion and the second rotor has a second portion which overlaps the first portion between the facing surfaces.

7. The combination according to claim 6 wherein the facing surfaces are spaced from each other a first distance and with the first and second portions overlapped, the first and second portions have a combined thickness that is slightly less than the first distance.

8. The combination according to claim 6 wherein with the first and second portions overlapped, the combined thickness of the first and second portions is approximately equal to the first thickness.

9. The combination according to claim 1 wherein the second rotor has a second throat to receive a strike element.

10. The combination according to claim 9 wherein with the first and second rotors in their respective first latched positions, the first and second rotors cooperatively bound a receptacle to confine a strike element received in the first and second throats.

11. The combination according to claim 1 wherein the first rotor is pivotable relative to the housing between its first latched position and its release position.

12. The combination according to claim 1 wherein the first rotor is biased towards its release position.

13. The combination according to claim 1 in combination with a movable closure element.

14. The combination according to claim 13 in combination with a support for the movable closure element, the closure element movable relative to the support between first and second positions, and a strike element which is received by the first throat with the closure element in its first position.

15. In combination:

a) a closure element that is movable relative to a support between first and second positions; and b) a latch assembly on the movable closure element, said latch assembly comprising:

a housing attached to the movable closure element;

a first rotor movable relative to the housing selectively between a) a first latched position and b) a release position, the first rotor having first and second spaced legs and a first throat between the first and second legs to receive a strike element;

a second rotor movable relative to the housing selectively between a) a first latched position and b) a release position; and an operating assembly having a latched state and an unlatched state, the operating assembly in the latched state releasably maintaining the first rotor in its first latched position and the second rotor in its first latched position, wherein the first rotor is movable substantially parallel to a first reference plane as the first rotor moves between its first latched and release positions, the first rotor and/or the second rotor having a non-uniform thickness taken orthogonally to the reference plane, one of the first and second rotors having a first thickness between second and third, spaced, reference planes, each parallel to the first reference plane and spaced from each other by a distance equal to the first thickness, the other of the first and second rotors having a thickness substantially the same as the first thickness and residing substantially fully in the space between the second and third reference planes, the first and second rotors overlapping with each other at a first location so that the first and second rotors at the first location block a strike element in the first throat with the first and second rotors in their first latched positions, the first and second legs each overlapping the second rotor with the first and second rotors in their latched positions, wherein the first rotor has a body with a mounting portion that has the first thickness and is connected to the housing for guided movement relative to the housing as the first rotor changes between its first latched position and its release position and an extension from the mounting portion defining the first throat, the extension having a portion that has a second thickness that is less than the first thickness.

16. The combination according to claim 15 wherein the first rotor is pivotable relative to the housing about an axle between its first latched position and its release position, and the axle extends through the mounting portion of the first rotor.

17. The combination according to claim 15 wherein the operating assembly comprises a catch which engages the mounting portion of the first rotor to maintain the first rotor in its first latched position.

18. The combination according to claim 17 wherein the catch has a thickness on the order of the first thickness at a location where the catch engages the mounting portion of the first rotor.

19. The combination according to claim 18 wherein the first rotor has a stop surface that engages a surface on the catch to maintain the rotor in its latched position and the stop surface and surface on the catch both comprise a non-metal material.

20. The combination according to claim 19 wherein the stop surface and the surface of the catch each have a thickness on the order of the first thickness.

21. In combination:

a) a closure element;

b) a support for the closure element, the closure element selectively movable relative to the support between first and second positions;

c) a strike element on the support; and d) a latch assembly on the movable closure element, the latch assembly comprising:

a housing;

a first rotor movable relative to the housing selectively between a) the first latched position and b) a release position, the first rotor having first and second spaced legs and a first throat between the first and second legs to receive the strike element;

a second rotor movable relative to the housing selectively between a) a first latched position and b) a release position; and an operating assembly having a latched state and an unlatched state, the operating assembly in the latched state releasably maintaining the first rotor in its first latched position and the second rotor in its first latched position, wherein the first rotor is movable substantially parallel to a first reference plane as the first rotor moves between its first latched and release positions, wherein the first rotor has a non-uniform thickness taken orthogonally to the reference plane, wherein the first rotor has a body with a first mounting portion that has a first thickness and is connected to the housing for guided movement relative to the housing as the first rotor changes between its first latched position and its release position and a first extension from the first mounting portion defining the first throat, the first extension having a portion that has a second thickness that is less than the first thickness, the first mounting portion residing in a space bounded by second and third reference planes, each parallel to the first reference plane and spaced from each other a distance equal to the first thickness, the second rotor having a second mounting portion and a second extension from the second mounting portion which overlaps and cooperates with the first extension at a first location so that the first and second rotors at the first location block the strike element in the first throat with the first and second rotors in their first latched positions, the second extension residing at least partially in the space between the second and third reference planes, the housing having a wall with a surface adjacent to and facing the first and second rotors, the first and second rotors each having first and second flat surfaces bounding the entire dimension thereof taken orthogonally to the reference plane, the first surfaces on the first and second rotors substantially coplanar with respect to each other and the second surfaces on the first and second rotors substantially coplanar with respect to each other, the first and second legs each overlapping the second rotor with the first and second rotors in their latched positions.

22. The combination according to claim 21 wherein the first and second rotors are interchangeable, each with the other.

23. The combination according to claim 21 wherein the first rotor comprises a non-metal material.

24. The combination according to claim 21 wherein the housing comprises facing surfaces which bound a chamber, the facing surfaces spaced from each other a first distance, and the first rotor has a portion with a thickness that is slightly less than the first distance.

25. The combination according to claim 21 wherein the housing comprises facing surfaces which bound a chamber, the first rotor has a first portion and the second rotor has a second portion which overlaps the first portion between the facing surfaces.

26. The combination according to claim 25 wherein the facing surfaces are spaced from each other a first distance and with the first and second portions overlapped, the first and second portions have a combined thickness that is slightly less than the first distance.

27. The combination according to claim 25 wherein the combined thickness of the first and second portions is approximately equal to the first thickness.

28. The combination according to claim 27 wherein the first rotor is pivotable relative to the housing about an axle between its first latched position and its release position, and the axle extends through the mounting portion of the first rotor.

29. The combination according to claim 21 wherein the second rotor has a second throat to receive a strike element.

30. The combination according to claim 29 wherein the first and second rotors in their respective first latched positions, the first and second rotors cooperatively bound a receptacle to confine a strike element received in the first and second throats.

31. The combination according to claim 21 wherein the first rotor is pivotable relative to the housing between its first latched position and its release position.

32. The combination according to claim 21 wherein the operating assembly comprises a catch which engages the mounting portion of the first rotor to maintain the first rotor in its latched position.

33. The combination according to claim 32 wherein the catch has a thickness on the order of the first thickness.

34. The combination according to claim 33 wherein the first rotor has a stop surface that engages a surface on the catch to maintain the rotor in its latched position and the stop surface and surface on the catch both comprise a plastic material.

35. The combination according to claim 34 wherein the stop surface and the surface of the catch each have a thickness on the order of the first thickness.

36. The combination according to claim 21 wherein the first rotor is biased towards its release position.

37. The combination according to claim 21 wherein the first and second rotors are respectively pivotable around first and second axes and the first and second axes are at all times fixed with respect to each other.

38. In combination:

a) a closure element that is movable relative to a support between first and second positions; and b) a latch assembly on the movable closure element, said latch assembly comprising:

a housing;

a first rotor movable relative to the housing selectively between a) a first latched position and b) a release position, the first rotor having first and second spaced legs and a first throat between the first and second legs to receive a strike element;

a second rotor movable relative to the housing selectively between a) a first latched position and b) a release position; and an operating assembly having a latched state and an unlatched state, the operating assembly in the latched state releasably maintaining the first rotor in its first latched position and the second rotor in its first latched position, wherein the first rotor is movable substantially parallel to a first reference plane as the first rotor moves between its first latched and release positions, the first rotor and/or the second rotor having a non-uniform thickness taken orthogonally to the reference plane, the first and second legs each overlapping the second rotor with the first and second rotors in their latched positions, one of the first and second rotors having a first thickness residing in a space between second and third, spaced, reference planes, each parallel to the first reference plane and spaced from each other a distance equal to the first distance, the other of the first and second rotors residing substantially fully in the space between the second and third reference planes, the first and second spaced legs each overlaps the second rotor so that the first and second legs and the second rotor cooperate to block a strike element in the first throat with the first and second rotors in their first latched positions.

39. The combination according to claim 38 wherein the second rotor has third and fourth spaced legs that each overlaps the first rotor at the first location so that the first, second, third and fourth legs surround a strike element in the first throat with the first and second rotors in their first latched positions.

* * * * *